US005513456A

United States Patent [19]

Gleason

[11] Patent Number: 5,513,456

[45] Date of Patent: May 7, 1996

[54] METHOD AND DEVICE FOR MAKING LISTS

[76] Inventor: Douglas M. Gleason, 1011 Arlington Blvd., Apt. 931, Arlington, Va. 22209

[21] Appl. No.: 258,355

[22] Filed: Jun. 10, 1994

Related U.S. Application Data

[63] Continuation of Ser. No. 897,088, Jun. 11, 1992, abandoned.

[51] Int. Cl.[6] ..... B43M 17/00

[52] U.S. Cl. ..... 40/358; 40/594; 40/657

[58] Field of Search ..... 40/341, 358, 585, 40/594, 597, 606, 611, 657; 206/44 B, 224, 371, 447; 248/225, 910; 211/50; D20/10, 15, 40; D6/310, 312; D19/286; 156/247, 249, 344; 428/40; 434/202

[56] References Cited

U.S. PATENT DOCUMENTS

| | | | |
|---|---|---|---|
| D. 182,451 | 4/1958 | Brandon | D19/86 |
| D. 234,563 | 3/1975 | Williams | D6/310 |
| D. 247,598 | 3/1978 | Kearney | D20/10 |
| D. 269,529 | 6/1983 | Luen . | |
| D. 270,739 | 9/1983 | Pearson . | |
| D. 270,740 | 9/1983 | Pearson . | |
| D. 271,501 | 11/1983 | Manning et al. | D19/86 |
| D. 271,981 | 12/1983 | Pearson . | |

(List continued on next page.)

OTHER PUBLICATIONS

3M Advertisement Brochure, undated: pp. 1, 4–9, 11, 22, 28.

Ampad Corp., Action Clingers Advertisement Brochure, 1987: pp. front and back.

Ampad Corp., Clingers Advertisement Brochure, 1987: pp. 1–4.

Andrews Office Supply & Equipment Co., Inc., Andrews Office Products Catalog, 1991: First Part pp. 39, 50–51, 60, 63, 71, 98–99, 104, 110–111, 117, 135, 148, 150, 154–161, 173–174, 178–180, 190, 212, 239, 257–258; Second Part pp. 39–40, 95, 97–100, 111, 189–190, 195–198, 200–201, 221, 266–267, 269, 271, 286, 291, 300, 325, 327–329, 333–341, 353–359, 375, 380–381, 440–441, 466, 483, 486, 489, 513–515, 539, 542, 617–619, 704–711, 726–729, 794–797, 828, 886.

Eldon Industries, Inc., Eldon Office Products Catalog, 1989: pp. front cover, 5, 15, 23, 26, 34–35, 39–41, back cover.

Rediform Catalog, undated: pp. 66–67, back cover.

Rediform, Note Stix Advertisement Brochure, undated: pp. front cover, 1–6, back cover.

Rediform, Note Stix Advertisement Brochure, undated.

Regional Office Supply, Office Products 1993 Catalog: pp. inside front cover, 71–72, 82, 96, 104, 106–108, 112, 117–119, 129, 211, 213–214, 217–218, 237, 287–289, 291, 306, 318–319, 335, 337, 341–345, 349, 352–357, 360–361, 390–391, 395, 401–405, 457–458, 480, 498, 500–501, 507, 531–533, 562–563, 643–646, 678–684, 763–765, 768, 833–835, 862, 884, 922, back cover.

Sanford Corp., Sterling Specifier Series Fan–Folded Advertisement Brochure, undated.

Sanford Corp., Sterling Plastics Catalog, undated: p. 9.

Tenex Corp., Tenex Desk Accessories Fan–Folded Advertisement Brochure, undated.

Tops, Tops Bulletin, Sep. 1991: pp. front and back.

*Primary Examiner*—Brian K. Green

*Attorney, Agent, or Firm*—Covington & Burling

[57] ABSTRACT

A method and device for making lists utilizing a compact desk-top apparatus on which lists of items can be compiled by writing the items on reusable adhesive-backed strips of paper (48) and pressing those strips onto a flat, upright palette (22). The base (20), in which the palette rests, as well as the palette itself, the palette extension (28), and highlight tabs (24) with colored arrows (52) for emphasizing particular listed items, are made of a hard, durable material such as plastic. The palette can be separated from the base (20) and attached to a suction cup (40) or swing arm for placement of the palette wherever the user desires. The palette can be lengthened using the palette extension (28) so as to provide more space for listed items. The base has a storage compartment (32) in which extra paper strip pads (26) are kept. The base also has an aperture on top which serves as a pen holder (34). Other possible features could be included as well.

18 Claims, 2 Drawing Sheets

U.S. PATENT DOCUMENTS

| | | | |
|---|---|---|---|
| D. 273,798 | 5/1984 | Pearson . | |
| D. 303,400 | 9/1989 | Higgins, Jr. | D19/86 |
| D. 305,246 | 12/1989 | Kirchhoff et al. . | |
| D. 305,553 | 1/1990 | Pugliese et al. . | |
| 1,006,334 | 10/1911 | Wright . | |
| 1,759,432 | 5/1930 | Brecht | D6/310 X |
| 1,972,024 | 8/1934 | Lewis | 248/910 |
| 2,688,331 | 9/1954 | Bogoslowsky | 156/249 |
| 2,697,293 | 12/1954 | Greenhut | 40/606 |
| 3,863,882 | 2/1975 | Hatcher | 248/910 |
| 3,958,816 | 5/1976 | Remmey, III | 428/42 |
| 4,176,743 | 12/1979 | Fitzpatrick | 211/50 |
| 4,291,882 | 9/1981 | Del Monte | 40/606 |
| 4,696,399 | 9/1987 | Windorski | 211/50 |
| 4,796,847 | 1/1989 | Kayner . | |
| 4,919,276 | 4/1990 | Kim et al. | 211/50 |
| 4,979,323 | 12/1990 | Wenkman et al. | 40/597 |
| 5,090,733 | 2/1992 | Bussiere . | |
| 5,195,265 | 3/1933 | Klingenberg | 283/81 X |

METHOD AND DEVICE FOR MAKING LISTS

This application is a continuation of application Ser. No. 07/897,088, filed Jun. 11, 1992, now abandoned.

BACKGROUND

1. Field of Invention

This invention is a method and device for making lists utilizing a compact apparatus with removable paper strips that can be continuously updated.

2. Discussion of Background

This invention constitutes a compact, easy to use, versatile, and inexpensive means of making and continuously revising lists of items. It allows the user to write listed items on individual strips of paper which can be included or excluded from the list at will. This permits the user to maintain a current list at all times, to reorder the listed items at will, and to eliminate the clutter of items that are no longer needed. The device includes highlighting tabs that can be used to signal which items are more important than others; this highlighting can be completely changed at will. Because the invention can be positioned wherever the user desires, it keeps the list visible at all times, makes the list difficult to lose, obviates clutter, and maximizes versatility. It is easy to use, inexpensive to make and sell, durable, convenient, and socially beneficial.

Heretofore, list-making has mainly been done on single sheets of paper. Recently, computers have come into use for this purpose as well. There are disadvantages to each of these approaches that the present invention overcomes.

Lists on single sheets of paper are problematic in that, once a large number of listed items have appeared on the paper and been lined-through, the remaining list can be messy and difficult to follow. This can result in the overlooking of some of the listed information and usually makes it necessary to re-write the list from scratch on a new sheet of paper. Lists written on sheets of paper can get lost under other paper on a crowded desk or inside a book, bag, or pocket. This raises a further problem in that, for some people, when a list goes out of sight, it goes out of mind.

Even when a paper list does not get lost, problems still arise. The items on a paper list cannot be re-arranged unless they are written in an erasable ink or pencil, and then the re-writing can be time-consuming. And, although items on a paper list can be highlighted as important using stars, check marks, or the like, subsequent changes in the order of importance can make the highlighting visually cluttered and difficult to follow without a review of the entire list to check for possible omissions.

Computer programs that generate lists solve many of these problems, but create different ones, ones that the instant invention averts. For the person who is not in a full-service office, the expense of the hardware and software needed to obtain a computer list program can be great. Even small hand-held computer list devices can be expensive. Misplacing one of these units can be financially painful.

Even for those who have access to a computer with a list program, there exist problems that do not arise with a hand-written list. Learning to use the program, remembering the required commands, and keeping up with the latest advances in technology can use up time, raising a barrier to using the list program that dissuades some people. Once a program is memorized, there is the further barrier of the extra steps required to gain access to the list and to manipulate the information on it. Because of the need to back-up computers and to turn screens off to prevent burn-in, a number of time-consuming steps must be followed almost every time the list program is used. Finally, from the perspective of the manufacturer, production and marketing of computer devices for list-making is a resource-intensive undertaking requiring considerable technological expertise.

In sum, the extant methods and devices for making lists pose numerous complications and drawbacks. The instant invention overcomes these problems. It can be continuously updated. Highlighting is easy and reversible at will. The device can be placed where the user wishes, so that it is always visible, easy to work on, and difficult to lose. No special training is needed to understand and use this invention. Finally, it is intended to be easy and inexpensive to manufacture, sold through existing office supply distribution networks, and inexpensive to purchase and use.

SUMMARY OF INVENTION

It is an object of this invention to provide a method and device to enable the user to maintain an up-to-date, orderly, easy-to-follow list of items free from the clutter of old, no longer needed information. Because the list is on its own free-standing board that can be positioned to suit the convenience of the user, it performs the function of reminding the user of the listed items better than the current methods, while it is simultaneously harder to lose. Other objects of the invention are to eliminate the need to re-write or erase and to allow highlighting and changes thereto at will. The invention is intended to require no special training, to be easy to use, and to be compact, inexpensive and easy to manufacture, and affordable by almost anyone.

Accordingly, this invention includes a compact device designed for producing a list of written items using individual paper strips, comprising: (a) a base, and (b) a palette, or board, having two major surfaces extending upward from said base, whereby a human being can easily and conveniently compile a list and then alter it at will. The invention further provides a method for creating and revising lists of written items, comprising the steps of: (a) writing the items on individual strips of paper, and (b) affixing the strips to a compact list-making device having a palette, or board, such that the written items on the individual paper strips may be freely altered, re-arranged, or deleted, whereby the process of making and revising lists is made easier. Finally, the invention provides a pad of long, narrow paper strips, each having a reusable adhesive portion covering the majority of one major surface of said strip and suitable for affixing said strip to a major surface of a palette or board, whereby a human being may produce a list of items by writing on said strips and attaching them to said palette as desired. Further objects and advantages of the invention will become apparent from consideration of the accompanying drawings and the ensuing description.

Figure 1:
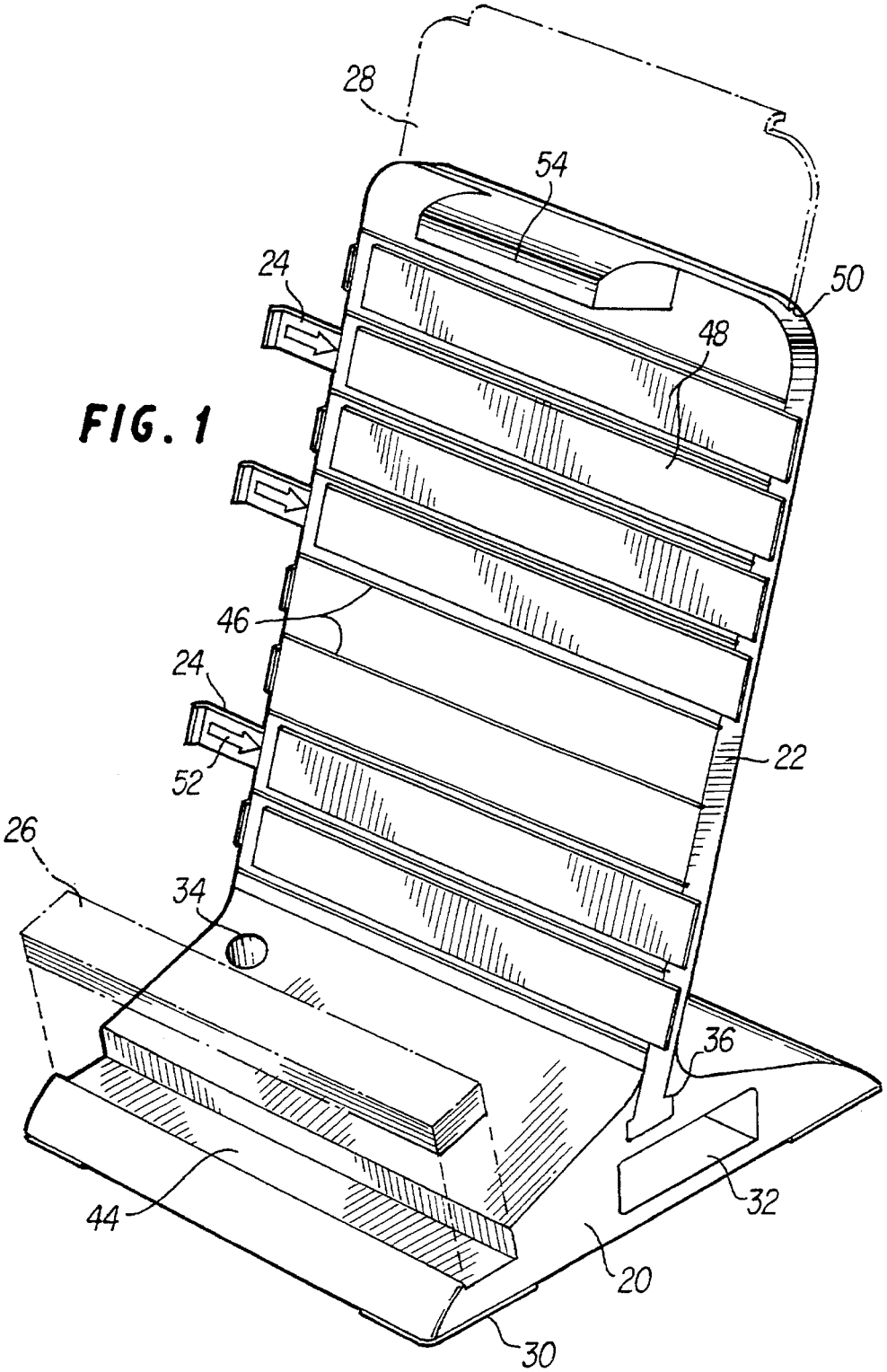
FIG. 1 is a perspective view of the front and side of the list-making device.

| List of Reference Numerals | |
|---|---|
| 20 | base |
| 22 | palette |
| 24 | highlight tab |
| 26 | paper strip pad |
| 28 | palette extension |
| 30 | rubber feet |
| 32 | storage compartment |
| 34 | pen/pencil holder |
| 36 | base/palette union |
| 38 | swing arm/suction cup attachment |
| 40 | suction cup |
| 42 | weight |
| 44 | indented space |
| 46 | position lines |
| 48 | paper strip |
| 50 | palette aperture |
| 52 | colored arrow |
| 54 | light fixture |

DETAILED DESCRIPTION OF THE PREFERRED EMBODIMENTS

FIG. 1 shows a front perspective view of a preferred embodiment of the list-making device. The foundation of the device is base 20, which rests on four rubber feet 30. Rising out of base 20 is palette, or board, 22. On the top front surface of base 20 is paper strip pad 26, which rests inside indented space 44. Next to paper strip pad 26 is pen/pencil holder 34, into which a pen or pencil can be placed upright. Pen/pencil holder 34 can be located on either side of paper strip pad 26, depending on whether a right-handed or a left-handed version of the list-making device is being viewed.

As FIG. 1 shows, low in the middle of one side of the device is storage compartment 32, an aperture in which extra paper strip pads can be placed for storage. Above storage compartment 32 is located base/palette union 36. This is a dovetail joining of base 20 and palette 22 whereby the two can be joined together into one unit or slid apart to form separate parts.

FIG. 1 further indicates the relative positions of base 20 and palette 22. On the face of palette 22 appear indented position lines 46, which run horizontally across palette 22 and demark the spaces for placement of paper strips. Position lines 46 indicate numerous spaces for paper strips.

Figure 3:
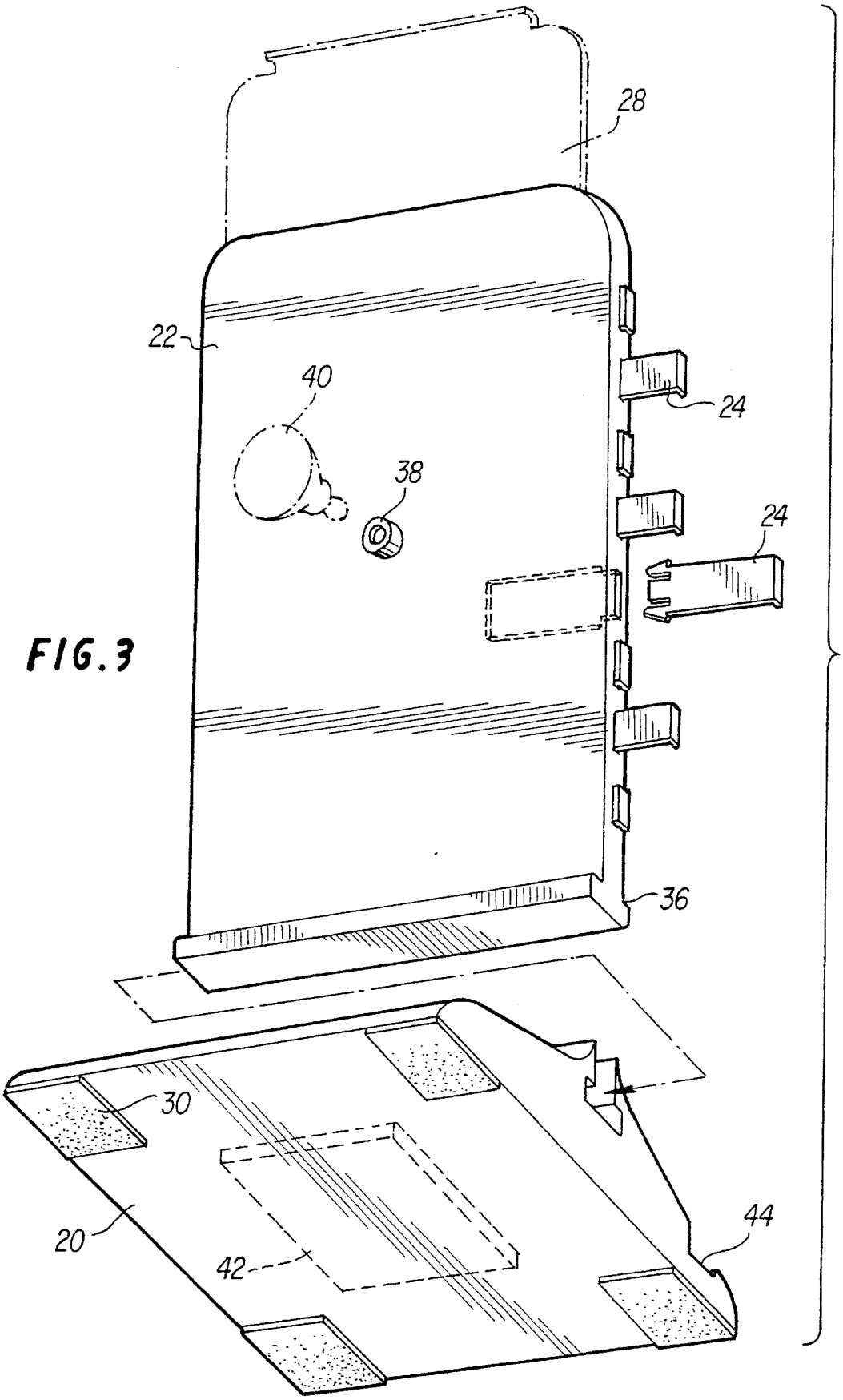
FIG. 3 is a perspective view of the rear and underside of the list-making device.

On one side of palette 22 are a number of highlight tabs 24 running from top to bottom. These tabs are fitted into slots in the side of palette 22. Each tab has a colored arrow 52 pointing toward the adjoining space. When a highlight tab is pulled out of its slot, a colored arrow 52 is revealed, highlighting the adjoining space in which a paper strip 48 has been placed. One method of attaching highlight tabs 24 to palette 22 is shown in FIG. 3.

Palette 22 measures approximately ten centimeters (four inches) wide by twenty-five centimeters (ten inches) high; these dimensions are not, however, essential to the nature of the invention and can be varied by the manufacturer to suit the needs of various possible users. For example, palette 22 could be made ten centimeters (four inches) high and twenty-five centimeters (ten inches) wide, forming a broad surface on which paper strips 48 could be placed vertically by users who write in a vertical script. Similarly, the number of spaces could be varied by the manufacturer.

As FIG. 1 further shows, at the top of palette 22, sliding vertically out of palette aperture 50, is palette extension 28. This is a thin, flat additional palette surface on which are marked further position lines 46 for placement of paper strips 48. Palette extension 28 allows additional space when all of the spaces on palette 22 are taken up by paper strips 42.

Figure 2:
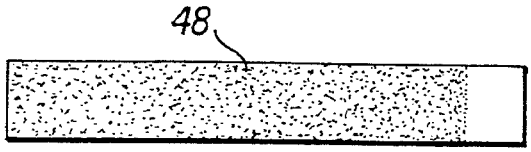
FIG. 2 is a rear view of a paper strip used as a part of the invention and shows the shape and form of said strip and of the adhesive portion of said strip.

FIG. 2 shows a view of the back side of one paper strip 48. Paper strip 48 is approximately one and one-half centimeters (one-half inch) wide and approximately ten centimeters (four inches) long. These measurements could be varied by the manufacturer to suit the intended user. The front of paper strip 48 is a paper surface on which a user may write or draw. The back side of paper strip 48 has a portion surfaced, except for approximately one and one-half centimeters (one-half inch) at one end, with a re-usable, mildly sticky adhesive strip of the sort found on the reverse of POST-IT brand note pads; POST-IT is a trademark of the 3M Company, Minneapolis, Minn. When placed on palette 22, the adhesive portion of the paper strip sticks to palette 22; the non-adhesive portion hangs over the side of palette 22 as shown in FIG. 1, forming a tab by which the paper strip may be grasped and removed from palette 22.

On the back of palette 22, as shown in FIG. 3, is located swing arm/suction cup attachment 38. This attachment forms a fitting at which suction cup 40 may be attached, so that palette 22, detached from base 20, may be attached via suction cup 40 to a glass computer screen or other smooth, flat surface. Alternatively, a swing arm can be attached to palette 22 at this fitting, so that palette 22 can be positioned wherever the attachment end of the swing arm is placed. The swing arm could follow a conventional elbow lamp arm form. FIG. 3 also shows a weight 42 of lead or other heavy material built into base 20 for stability.

Other possible ramifications exist as well. For example, a very thin version of palette 22 with paper strip pad indented space 44 built into the bottom of it could be produced for use as a mobile list-making device that could be carried in a briefcase. Listed items on paper strips could be transferred from such a mobile device to the desk-top device and vice-versa. Another possible ramification is the incorporation into the top of palette 22 of a miniature light fixture 54 and light bulb that would shine on palette 22 and illuminate the listed items on it.

OPERATION OF INVENTION

In order to use the above-described preferred embodiment of the list-making apparatus, the user places it on a flat, level surface, such as a desk. After placing a paper strip pad 26 into indented space 44, the user writes the first item to be included in the list onto the first paper strip 48. The user then peels that paper strip away from paper strip pad 26, positions the written-on paper strip on palette 22 between any two position lines 46, and presses the adhesive back of the paper strip onto palette 22 at that position so that the non-adhesive end of the paper strip extends past the side of palette 22 and forms a tab.

The user then repeats this operation for each succeeding listed item, placing one paper strip after another into position in open locations on palette 22. If the user desires to have more space on which to place paper strips, he can slide palette extension 28 out of palette aperture 50, thereby exposing additional surface area on which to place paper strips 48. If the user depletes paper strip pad 26, he can remove a new paper strip pad 26 from storage compartment 32, place the paper strip pad into indented space 44, and then continue to write listed items onto paper strips 48.

After the user has placed a number of paper strips 48 with listed items onto palette 22, he may wish to identify which of the listed items are most important or urgent. The user can do so by sliding highlight tabs 24 out from the side of palette 22 so that colored arrows 52 are revealed, drawing the user's attention to the adjacent paper strips with listed items. If the user then decides to eliminate the emphasis on a particular listed item, he slides that highlight tab 24 back into palette 22, making the colored arrow 52 disappear.

If the user chooses to move a paper strip 48 from one space on palette 22 to another, he can grasp that paper strip by its non-adhesive tab end, pull it off of palette 22, reposition it where desired, and press it into place. If the user wishes to delete a listed item, he can either strike a line through the paper strip and leave it affixed to palette 22 or peel the strip off and discard it.

Palette 22 can be separated from base 20 by sliding the two apart at base/palette union 36. The two can then be placed apart from each other, wherever the user desires. The user can, for example, leave base 20 on a desk and attach palette 22 to suction cup 40 at swing arm/suction cup attachment 38. The user can then attach palette 22 via suction cup 40 to a flat, smooth surface such as a computer screen or a window. Alternatively, the user can attach palette 22 to a swing arm at swing arm/suction cup attachment 38 and then position palette 22 at any desired position within the reach of the swing arm. It would also be possible to manufacture base 20 and palette 22 as two separate units intended always to be kept separate, depending on user preferences. In these ways the user would be free to position palette 22 wherever it suited his convenience, keeping the list visible and close at hand for easy alteration.

SUMMARY, RAMIFICATIONS, AND SCOPE

The reader will, accordingly, see that this invention constitutes a convenient, easy to use, inexpensive, and versatile apparatus and method for compiling and readily revising lists of items. The invention allows the user to create a list of items in any desired order, to alter that order at will, to emphasize or deemphasize particular items in the list as desired through the use of highlighting tabs, and to delete items from the list without adding clutter. This invention has additional advantages in that:

- it can be placed where the user desires through the use of suction cup and swing arm attachments, so that the list of items will be visible and conveniently located;
- it requires neither special training nor memorization of detailed instructions for its use, unlike computer-based list-making devices;
- it can be manufactured and distributed inexpensively and so be available to large numbers of users at low cost;
- it can be made of rugged, durable materials and so provide long use; and
- it can easily be configured for maximum ease of use by a wide variety of persons, e.g., those who write vertically, those who are left- rather than right-handed, etc.

Although the description above contains many specifics, these should not be construed as limiting the scope of the invention, but rather as merely providing illustrations of some of its presently preferred embodiments. For example, the device could: be produced in a variety of shapes, sizes, colors, and materials; have additional convenience features such as a light fixture, multiple pen holders, etc.; be developed as a portable model for use on the road; have any one of a variety of connections for base and palette, palette and suction cup, palette and swing arm, etc. The scope of this invention should, thus, be determined by the appended claims and their legal equivalents, rather than by the embodiments illustrated.

I claim:

1. A combination for making and displaying lists, comprising:

a base having a top surface and a bottom;

a palette having a face and extending from the top surface of the base away from the bottom of the base, said palette having a pair of side edges, a top edge and a bottom edge, and the face having a height between the top and bottom edges of said palette and a width between the pair of side edges of said palette;

a first plurality of strips, wherein each strip in the first plurality of strips comprises:

a front suitable for displaying writing;

a back applied with sufficient re-usable, pressure-sensitive adhesive for adhering the strip substantially against the face, wherein the back further comprises a tab having no adhesive at an end of the strip;

two substantially parallel sides;

a length along the two substantially parallel sides in the range approximately from three inches to six inches; and a width between the two substantially parallel sides in the range approximately from one-quarter inch to one inch and not greater than approximately one-third of the length;

wherein the face of the palette forms a surface with sufficient area for simultaneously displaying a second plurality of strips with each strip in the second plurality of strips spaced apart in the form of a list on the face of the palette;

wherein the height of the face of the palette measures at least twice the width of each strip in the first plurality of strips; and wherein the length of each strip in the first plurality of strips extends in a direction generally parallel to the top and bottom edges of the face of the palette when each strip in the first plurality of strips adheres substantially to the face of the palette.

2. The combination as set forth in claim 1, wherein each strip further comprises paper.

3. The combination as set forth in claim 1, wherein the plurality of strips forms a pad.

4. The combination as set forth in claim 1, wherein the face of the palette further comprises two substantially parallel sides.

5. The combination as set forth in claim 4, wherein the face of the palette has a distance between the two substantially parallel sides in the range approximately from three inches to nine inches.

6. The combination as set forth in claim 1, further comprising means for storing the plurality of strips at the top surface.

7. The combination as set forth in claim 6, further comprising means for selectively highlighting the plurality of strips adhered against the face of the palette.

8. The combination as set forth in claim 6, further comprising means for attaching the combination to a suspension device.

9. The combination as set forth in claim 1, wherein the base forms an indented space at the top surface suitable for holding the plurality of strips.

10. The combination as set forth in claim 1, wherein the base forms a substantially rectangular indented space at the top surface, the indented space having a length in the range from approximately two inches to seven inches and a width in the range approximately from one-eighth inch to one-and-one-half inch.

11. The combination as set forth in claim 1, wherein:

each of the plurality of strips further comprises a uniform length selected from the range from three inches to six inches; and wherein the base forms a substantially rectangular indented space at the top surface, the indented space having a length no more than approximately one-half inch greater than the uniform length, the indented space further having a width in the range approximately from one-eighth inch to one-and-one-half inch.

12. The combination as set forth in claim 1, wherein:

each of the plurality of strips further comprises a uniform length selected from the range from three inches to six inches; and wherein the base forms a substantially rectangular indented space at the top surface, the indented space having a length no more than approximately one-half inch less than the uniform length, the indented space further having a width in the range approximately from one-eighth inch to one-and-one-half inch.

13. The combination as set forth in claim 1, further comprising means for selectively highlighting the plurality of strips adhered against the face of the palette.

14. The combination as set forth in claim 1, further comprising means for attaching the combination to a suspension device.

15. A combination for making and displaying lists, comprising:

a base having a top surface;

a palette joining the base and having a face;

a plurality of strips, wherein each strip comprises:

a front suitable for displaying writing;

a back applied with sufficient re-usable, pressure-sensitive adhesive for adhering the strip substantially against the face, wherein the back further comprises a tab having no adhesive at an end of the strip;

two substantially parallel sides;

a length along the two substantially parallel sides in the range approximately from three inches to six inches; and a width between the two substantially parallel sides in the range approximately from one-quarter inch to one inch and not greater than approximately one-third of the length; and means for selectively highlighting the plurality of strips adhered against the face of the palette, wherein the highlighting means comprises sliding tabs.

16. The combination as set forth in claim 15, further comprising:

means at the top surface for storing the plurality of strips.

17. A combination for making and displaying lists, comprising:

a base having a top surface;

a palette joining the base and having a face and comprising a reversibly sliding palette extension; and a plurality of strips, wherein each strip comprises:

a front suitable for displaying writing;

a back applied with sufficient re-usable, pressure-sensitive adhesive for adhering the strip substantially against the face, wherein the back further comprises a tab having no adhesive at an end of the strip;

two substantially parallel sides;

a length along the two substantially parallel sides in the range approximately from three inches to six inches; and a width between the two substantially parallel sides in the range approximately from one-quarter inch to one inch and not greater than approximately one-third of the length.

18. The combination as set forth in claim 17, further comprising:

means at the top surface for storing the plurality of strips.

* * * * *